US005794428A

United States Patent [19]

Rhodes et al.

[11] Patent Number: 5,794,428

[45] Date of Patent: Aug. 18, 1998

[54] METHOD OF BULKING AND HEAT-SETTING A MOVING, CONTINUOUS LENGTH OF TWISTED THERMOPLASTIC YARN

[76] Inventors: Cheryl Elizabeth Rhodes; Clifford Nelson Rhodes, both of 18301 Mandrian Point Dr., Cornelius, N.C. 28031

[21] Appl. No.: 654,954

[22] Filed: May 29, 1996

[51] Int. Cl.[6] ..... D02G 1/20

[52] U.S. Cl. ..... 57/292; 57/286; 28/265

[58] Field of Search ..... 28/262, 263, 265; 57/285, 286, 282, 292, 290, 264, 351

[56] References Cited

U.S. PATENT DOCUMENTS

| | | | |
|---|---|---|---|
| 3,409,957 | 11/1968 | Carter | 28/265 |
| 3,500,519 | 3/1970 | Stanley | 28/265 |
| 3,672,012 | 6/1972 | Burklund | 28/1.2 |
| 3,745,618 | 7/1973 | Burklund | 28/72.1 |
| 3,831,368 | 8/1974 | Glowacki | 57/140 BY |
| 3,961,401 | 6/1976 | Ferrier et al. | 28/1.3 |
| 3,965,511 | 6/1976 | Fleissner | 8/149 |
| 4,115,985 | 9/1978 | Venot | 57/34 HS |
| 4,207,730 | 6/1980 | Lorenz | 57/351 |
| 4,341,361 | 7/1982 | Shaikh | 245/130.4 |
| 5,175,406 | 12/1992 | Roussy et al. | 219/10.61 R |
| 5,228,282 | 7/1993 | Tinsley et al. | 57/333 |
| 5,233,736 | 8/1993 | Hill | 28/265 |

FOREIGN PATENT DOCUMENTS

| | | |
|---|---|---|
| 2029183 | 1/1971 | Germany . |
| 2047120 | 3/1972 | Germany . |

*Primary Examiner*—Daniel P. Stodola
*Assistant Examiner*—Tina R. Taylor
*Attorney, Agent, or Firm*—Adams Law Firm, P.A.

[57] ABSTRACT

A method of bulking and heat-setting a moving, continuous length of twisted thermoplastic yarn. The method includes the steps of saturating the yarn with a dielectric fluid contained in a fluid saturation station. The yarn is then moved downstream from the saturation station to an electromagnetic heating chamber for heating the yarn using electromagnetic radiation. Simultaneously in the heating chamber, the yarn is bulked to add size and texture and the twist permanently heat-set. The twisted and bulked yarn is then collected in a collection station located downstream of the heating chamber.

8 Claims, 1 Drawing Sheet

METHOD OF BULKING AND HEAT-SETTING A MOVING, CONTINUOUS LENGTH OF TWISTED THERMOPLASTIC YARN

TECHNICAL FIELD AND BACKGROUND OF THE INVENTION

This invention relates to a method of bulking and heat-setting a moving, continuous length of twisted thermoplastic yarn. The invention achieves permanent twist retention and bulking in the yarn in a manner resulting in improved operating and energy costs over conventional heat setting processes. Yarn bulking and heat-setting takes place in a single, continuous operation over a relatively short period of time.

According to one prior art process, heat setting of the yarn is achieved by the application of heated steam contained in a pressurized vessel at 240–270 degrees F. The yarn enters the vessel on a conveyor belt in a saturated, unwound condition. In an alternative process, the yarn is unwound on a skein and exposed to heat from an autoclave press. These such methods generally require precise temperature controls, relatively high energy use associated with convection heating, substantial floor space, and typically, a source of pressurized steam or forced air.

Another process disclosed in U.S. Pat. No. 4,207,730 involves the bulking of yarn using microwave energy. According to this process, however, the yarn is made of fibers having different shrinkage characteristics, and bulking is achieved by rapidly heating the yarn in a saturated condition in a microwave resonator. High-bulking results from the differential shrinkage of the individual yarn fibers. The '730 patent does not describe simultaneously setting the twist of the yarn during this bulking process.

The present invention addresses these and other problems of the prior art by providing a method of heat-setting and bulking twisted yarn in an efficient and economical manner. The invention requires relatively little floor space, and results in time and energy savings over conventional yarn heat-setting and bulking processes.

SUMMARY OF THE INVENTION

Therefore, it is an object of the invention to provide a method of simultaneously bulking and heat-setting a moving, continuous length of twisted thermoplastic yarn in a single, continuous operation.

It is another object of the invention to provide a method of bulking and heat-setting a yarn which utilizes electromagnetic energy to rapidly heat the yarn.

It is another object of the invention to provide a method of bulking and heat-setting a yarn which is more cost efficient than methods using convection heating.

It is another object of the invention to provide a method of bulking and heat-setting a yarn which requires less time than methods using convection heating.

It is another object of the invention to provide a method of bulking and heat-setting a yarn which is not made of fibers having different shrinkage characteristics in order to achieve high-bulking.

It is another object of the invention to provide an apparatus for bulking and heat-setting a yarn which requires relatively little floor space.

These and other objects of the present invention are achieved in the preferred embodiments disclosed below by providing a method of bulking and heat-setting a moving, continuous length of twisted thermoplastic yarn. The method includes the steps of saturating the yarn with a dielectric fluid contained in a fluid saturation station. The yarn is then moved downstream from the saturation station to an electromagnetic heating chamber for heating the yarn using electromagnetic radiation. In the heating chamber, the yarn is bulked to add size and texture, and the twist permanently heat-set. The twisted and bulked yarn is then collected in a collection station located downstream of the heating chamber.

According to one preferred embodiment of the invention, the yarn saturating step includes immersing the yarn in a bath of water to completely and uniformly saturate the fibers of the yarn with water.

According to another preferred embodiment of the invention, the yarn collecting step includes providing a motor driven take-up device located in the collection station downstream of the heating chamber for collecting the heat-set and bulked yarn.

According to yet another preferred embodiment of the invention, the method includes the step of controlling the take-up device to move the yarn downstream from the saturation station through the heating chamber and to the collection station in a substantially tensionless condition.

According to yet another preferred embodiment of the invention, the step of controlling the take-up device includes providing a photoelectric sensing mechanism connected to the take-up device for sensing and adjusting the tension in the moving yarn.

According to yet another preferred embodiment of the invention, the steps of bulking and heat-setting the yarn include moving the yarn through the heating chamber at a rate of between 20 and 300 m/min.

According to yet another preferred embodiment of the invention, the method includes the step of drying the yarn in a dryer station downstream of the heating chamber and upstream of the collection station for removing any residual fluid from the heat-set and bulked yarn.

According to yet another preferred embodiment of the invention, the yarn saturating step includes saturating the yarn with the dielectric fluid to obtain a moisture content of between 30% to 150% by weight of the yarn mass as the yarn enters the heating chamber.

BRIEF DESCRIPTION OF THE DRAWING

Some of the objects of the invention have been set forth above. Other objects and advantages of the invention will appear as the description proceeds when taken in conjunction with the following drawing, in which.

DESCRIPTION OF THE PREFERRED EMBODIMENT AND BEST MODE

Figure 1:
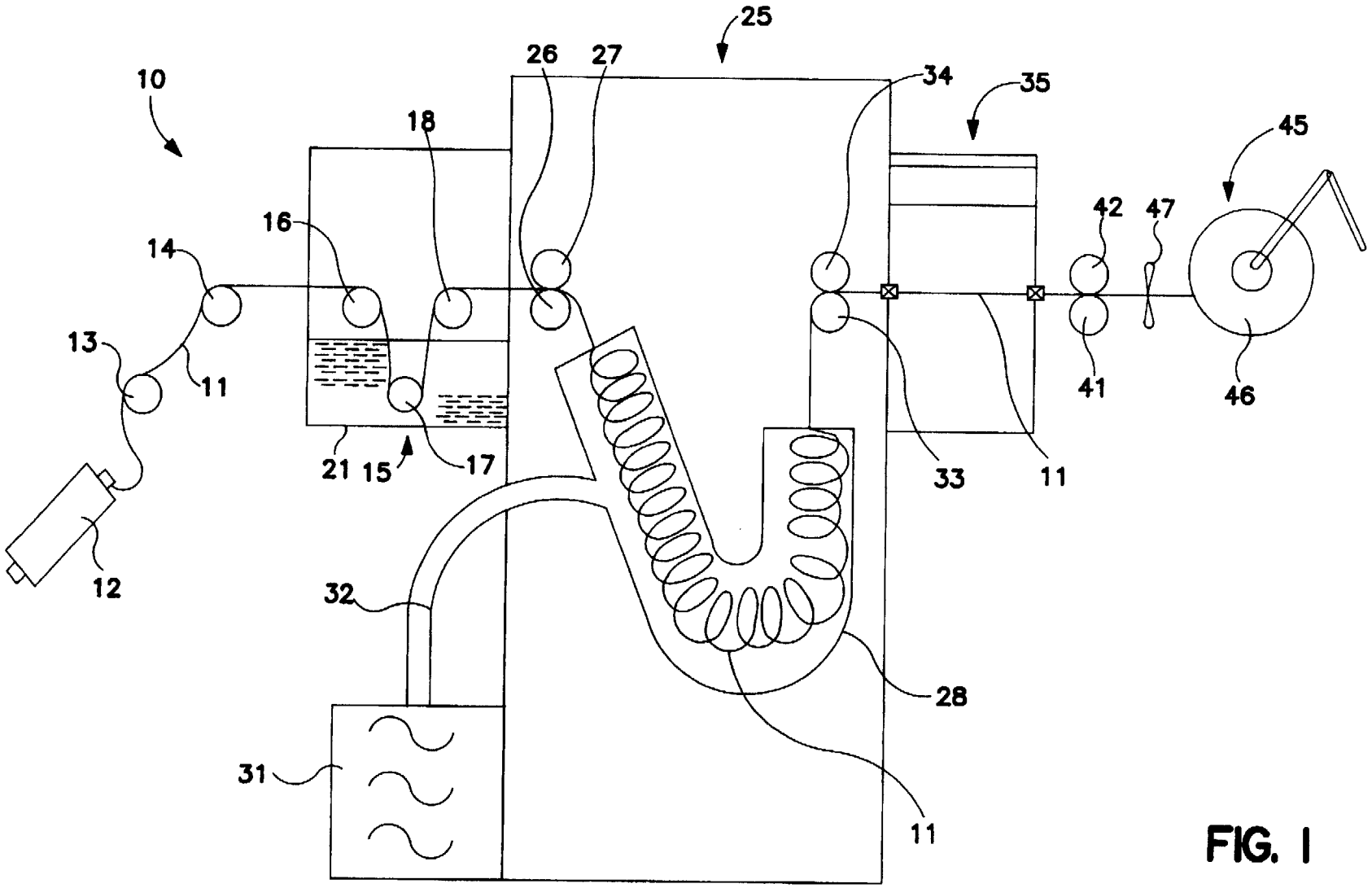
FIG. 1 is a schematic, side elevational view of an apparatus according to one preferred embodiment of the invention for bulking and heat-setting a moving, continuous length of twisted thermoplastic yarn.

Referring now specifically to the drawing, an apparatus for bulking and heat-setting a moving, continuous length of twisted thermoplastic yarn according to the present invention is illustrated in FIG. 1 and shown generally at reference numeral 10. The apparatus 10 occupies relatively little floor space in a textile processing facility by utilizing electromagnetic energy, as opposed to standard convection heating, for heating the yarn 11 to increase bulk and permanently set the twist in a single operation. The total increase in yarn bulk after processing is between 50% and 75% making the twisted yarn 11 particularly useful in, for example, cut pile carpet constructions. The yarn 11 is preferably a pre-drafted or drawn nylon, polypropylene, or polyester yarn which is cabled, and including an assembly of homogeneous fibers of relatively uniform shrinkage characteristics. The yarn 11 has a total denier of about 2500, and is formed by cabling two ends of 1250 denier yarn. Alternatively, the yarn includes a two-for-one twist.

As shown in FIG. 1, an end of cabled yarn 11 enters the apparatus 10 from a supply package 12 located at an upstream end of the apparatus 10, and is passed over successive guide rollers 13 and 14 to a yarn saturation station 15. In the saturation station 15, guide bars 16, 17, and 18 direct movement of the yarn 11 through a liquid bath 21 containing water or other dielectric fluid. The yarn 11 is completely immersed in the bath 21 to fully saturate the fibers throughout the entire yarn cross-section. Preferably, the resulting moisture content of the yarn 11 exiting the saturation station 15 is between 30% to 150% by weight of yarn mass.

From the saturation station 15, the yarn 11 moves downstream to a heating station 25 including variable-speed drive rollers 26 and 27 and an electromagnetic heating chamber 28. The drive rollers 26, 27 are adjustable to control the feed rate of the yarn 11 from the saturation station 15 into the heating chamber 28. According to one embodiment, the heating chamber 28 is a conventional microwave resonator, such as that disclosed in U.S. Pat. No. 4,207,730 assigned to Palitex Project Company of Germany. The complete disclosure of this patent is incorporated herein by reference. A suitable microwave generator 31 is connected to the resonator through a coaxial cable 32 to supply microwave energy to the resonator at an operative frequency range and wavelength. The microwave resonator and generator are elements commonly known and understood by those of ordinary skill in this art, and will not be further described. In an alternative embodiment, ultrasonic radiation is used in the heating chamber 28 to rapidly and efficiently heat the yarn 11.

In the heating chamber 28, the saturated yarn 11 is heated to a temperature of between 100 and 130 degrees C. The water residing in the interstices of the yarn fibers acts as a dielectric cooperating with the microwave energy to provide complete and uniform heating of the yarn 11 throughout its entire cross-section. The yarn 11 is continuously moved downstream through the heating chamber 28 at a rate of between 20 and 300 m/min, and in a substantially tensionless condition as controlled by the drive rollers 26, 27. The preferred rate of yarn travel through the heating chamber 28 is approximately 80 m/min. The microwave energy absorbed by the yarn 11 is sufficient to change its molecular orientation and permanently heat-set the twist while simultaneously increasing the yarn bulk. The total dwell time of the yarn 11 in the heating chamber 28 is preferably about 20 to 25 seconds.

From the heating chamber 28, the twisted and bulked yarn 11 passes between rollers 33 and 34 to a dryer station 35 where the yarn 11 is cooled and any residual moisture removed. The dryer station 35 includes a conventional air dryer (not shown).

A second pair of rollers 41 and 42 directs the yarn downstream from the dryer station 35 to a collection station 45 where the yarn 11 is gathered on a motor driven take-up device 46 and packaged for subsequent use. A photoelectric sensing mechanism 47 is operatively connected to the motor of the take-up device 47 for sensing and controlling the tension in the yarn 11 as it is collected. From the apparatus 10, the heat-set and bulked yarn 11 is ready for processing in subsequent textile operations, such as cut pile carpet construction.

A method of bulking and heat-setting a moving, continuous length of twisted thermoplastic yarn is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A method of bulking and heat-setting a moving, continuous length of twisted thermoplastic yarn made of a homogeneous assembly of fibers having relatively uniform shrinkage characteristics, comprising the steps of:

(a) saturating the yarn with a dielectric fluid contained in a fluid saturation station;

(b) moving the yarn downstream from the saturation station to an electromagnetic heating chamber, and while the yarn is in the heating chamber:

(i) heating the saturated fibers of the yarn using electromagnetic radiation;

(ii) bulking the yarn through uniform shrinkage of the homogeneous fibers to increase the diameter and texture of the yarn;

(iii) simultaneously with heating and bulking the yarn, permanently setting the twist of each of the homogeneous fibers of the yarn; and (c) collecting the twisted and bulked yarn in a collection station located downstream of the heating chamber.

2. A method according to claim 1, wherein the yarn saturating step comprises immersing the yarn in a bath of water to completely and uniformly saturate the fibers of the yarn with water.

3. A method according to claim 1, wherein the yarn collecting step comprises providing a motor driven take-up device located in the collection station downstream of the heating chamber for collecting the heat-set and bulked yarn.

4. A method according to claim 3, and comprising the step of controlling the take-up device to move the yarn downstream through the heating chamber in a substantially tensionless condition.

5. A method according to claim 4, wherein the step of controlling the take-up device comprises providing a photoelectric sensing mechanism connected to the take-up device for sensing and adjusting the tension in the moving yarn.

6. A method according to claim 1, wherein the steps of bulking and heat-setting the yarn comprise moving the yarn through the heating chamber at a rate of between 20 and 300 m/min.

7. A method according to claim 1, and comprising the step of drying the yarn after step (d) and before step (e) in a dryer station downstream of said heating chamber and upstream of said collection station for removing any residual fluid from the heat-set and bulked yarn.

8. A method according to claim 1, wherein the yarn saturating step comprises saturating the yarn with the dielectric fluid to obtain a moisture content of between 30% to 150% by weight of the yarn mass as the yarn enters the heating chamber.

* * * * *